US007737351B2

(12) United States Patent
Suzuki

(10) Patent No.: US 7,737,351 B2
(45) Date of Patent: Jun. 15, 2010

(54) HEAD FOR A PERCUSSION INSTRUMENT

(75) Inventor: Kazumasa Suzuki, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 106 days.

(21) Appl. No.: 11/170,105

(22) Filed: Jun. 30, 2005

(65) Prior Publication Data

US 2006/0048630 A1 Mar. 9, 2006

(30) Foreign Application Priority Data

Sep. 3, 2004 (JP) ..... 2004-256571

(51) Int. Cl.
*G10D 13/02* (2006.01)

(52) U.S. Cl. ..... 84/411 R; 428/35.7

(58) Field of Classification Search ..... 84/411 R, 84/414, 416, 411 P, 418; 473/526; 428/35.7
See application file for complete search history.

(56) References Cited

U.S. PATENT DOCUMENTS 4,330,124 A * 5/1982 Vettorello ..... 473/526
5,837,915 A 11/1998 Suenaga
6,518,490 B2 * 2/2003 Good ..... 84/414
7,196,261 B2 * 3/2007 Suenaga ..... 84/730
2003/0190490 A1 * 10/2003 Kaya et al. ..... 428/492

FOREIGN PATENT DOCUMENTS

EP 0 795 849 A2 9/1997
EP 0 795 849 A3 9/1997
JP 56149351 A * 11/1981
JP H09-244633 9/1997

* cited by examiner

*Primary Examiner*—Jianchun Qin
(74) *Attorney, Agent, or Firm*—Dickstein Shapiro LLP

(57) ABSTRACT

A base 20 made of a steel plate is fasten to a case 10 made of ABS (acrylonitrilebutadiene-styrene) resin, while a pad 30 made of adhesive and elastic material such as urethane or olefin is fastened to the top surface of the base 20. To the reverse side of the surface of the pad 30 which is fastened to the base 20, i.e., to the side which is hit with sticks there is applied zinc oxide starch powder 40. A drumhead configured as described above can maintain flexibility but does not reduce repulsion between the sticks and drumhead.

12 Claims, 4 Drawing Sheets

FIG.4

| zinc oxide starch powder \ height where ball is dropped | 100mm | 300mm |
|---|---|---|
| not applied | 63.6% | 60.6% |
| applied | 72.3% | 66.0% |

HEAD FOR A PERCUSSION INSTRUMENT

BACKGROUND OF THE INVENTION

1. Field of the Invention

The present invention relates to a head applied to an electronic percussion instrument.

2. Description of the Related Art

As electronic musical instruments which emit electronic tones as their musical tones, electronic drums that are the electronic form of percussion instruments such as a drum are commercially available. One example of such electronic drums is disclosed in Japanese Laid-Open No. H9-244633. In this electronic drum, a strike sensor which is composed of a piezoelectric element, etc. is disposed on a drumhead. When the drumhead is struck with sticks, the strike sensor senses a strike to electronically emit, on the basis of the sensed strike, a corresponding musical tone.

As the drumhead of electronic drums, a member such as elastomer having elasticity and flexibility is used because the use of flexible elastomer produces the effect of reducing the noise emitted when sticks collide with the drumhead. The surface of many elastomeric materials having high flexibility, however, is also highly adhesive, making sticks adhesive at contact with the surface. Hence the adhesion imparted to the sticks causes reduced force of repulsion between the sticks and drumhead. As for acoustic drums, on the contrary, the force of repulsion is not reduced. There is a problem, therefore, electronic drums fail to deliver comfortable repulsion which acoustic drums can offer, making players feel strange when they play the electronic drums.

SUMMARY OF THE INVENTION

The present invention was accomplished to solve the above-described problem, and an object thereof is to provide a drumhead that maintains flexibility but does not reduce repulsion of sticks.

In order to achieve the above-described object, the present invention provides a head for a percussion instrument comprising a base member layer, an elastic member layer laminated on the top surface of the base member layer and having elastic and adhesive properties, and a powdery member applied to the top surface of the elastic member layer. In this case, the elastic member layer is a pad hit with a stick. The powdery member includes at least one of zinc oxide, zinc oxide starch powder, cornstarch, talc and silica.

In the present invention, the powdery member applied to the top surface of the elastic member layer (pad) having adhesive properties prevents a stick from directly touching the elastic member layer when the elastic member layer is hit with the stick. Consequently, the stick is prevented from adhering to the elastic member layer. As a result, the present invention can provide a drumhead having both flexibility and repulsion.

BRIEF DESCRIPTION OF THE DRAWINGS

FIG. 4 shows the result of an experiment that verified the effect of zinc oxide starch powder.

DESCRIPTION OF THE PREFERRED EMBODIMENT

Figure 1:
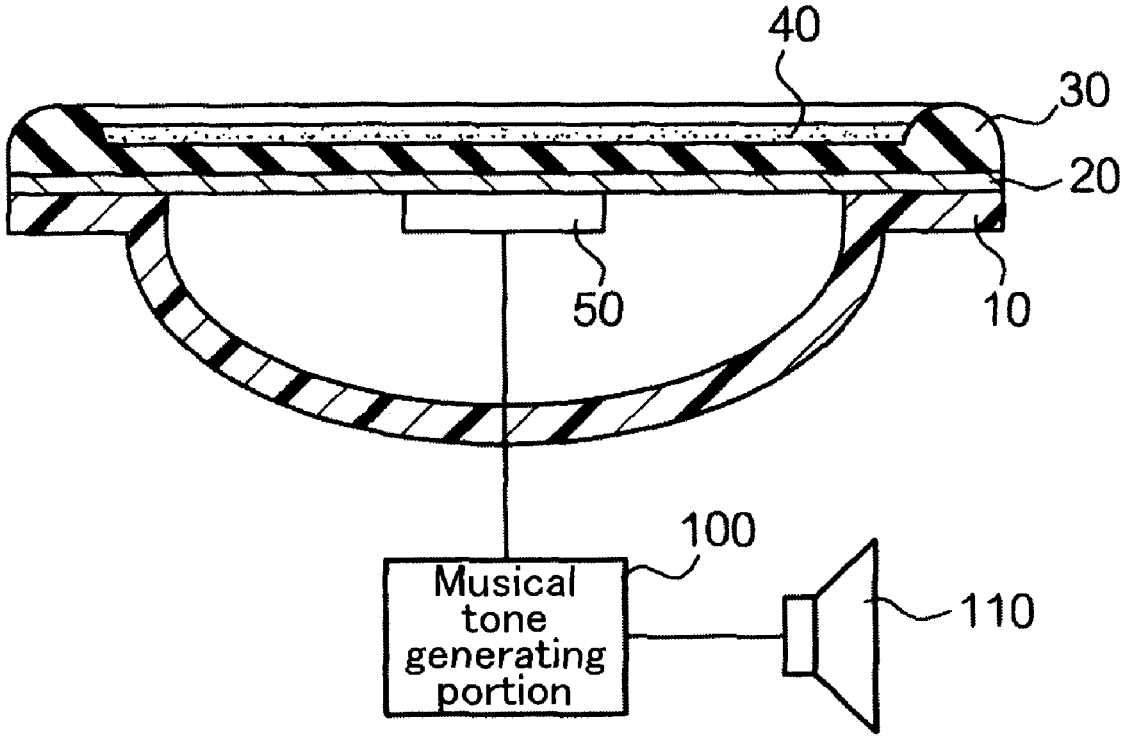
FIG. 1 is a diagram showing the configuration of an electronic drum according to an embodiment of the present invention.

A drumhead for percussion instruments according to an embodiment of the present invention will now be described with reference to the drawings. FIG. 1 is a diagram showing the configuration of an electronic drum according to an embodiment of the present invention. In FIG. 1, the cross-section of a case 10, a base 20, a pad 30 constituting a drumhead, and a vibration sensor 50 is shown. In order to facilitate the understanding of the configuration, the dimensions of members depicted in FIG. 1 are different from the actual dimensions.

The base 20, which is a steel plate, for example, is fastened to the case 10 that is made of ABS (acrylonitrilebutadiene-styrene) resin. The pad 30, which is made of adhesive and elastic material such as urethane or olefin, is fastened to the top surface of the base 20. The base 20 has a vibration sensor 50 on its reverse side (on the underside of the base 20 in FIG. 1) of the pad 30 which is hit with the sticks. The vibration sensor 50 is provided with a piezoelectric element to sense vibration produced on the base 20 when the pad 30 is hit with the sticks. The vibration sensor 50 then outputs a signal indicative of the sensed vibration. A musical tone generating portion 100 generates a musical tone signal on the basis of the signal output from the vibration sensor 50 and sends the generated signal to a speaker 110. The speaker 110 then emits a musical tone corresponding to the sent musical tone signal. To the reverse side of the surface of the pad 30 which is fastened to the base 20, i.e., to the side which is hit with the sticks there is applied zinc oxide starch powder 40 by use of adhesion of the pad 30. Since the pad 30 is adhesive, the zinc oxide starch powder 40 does not easily blow away. Even if the zinc oxide starch powder 40 is blown away by the hit with the sticks, the zinc oxide starch powder 40 can be applied again.

Figure 2:
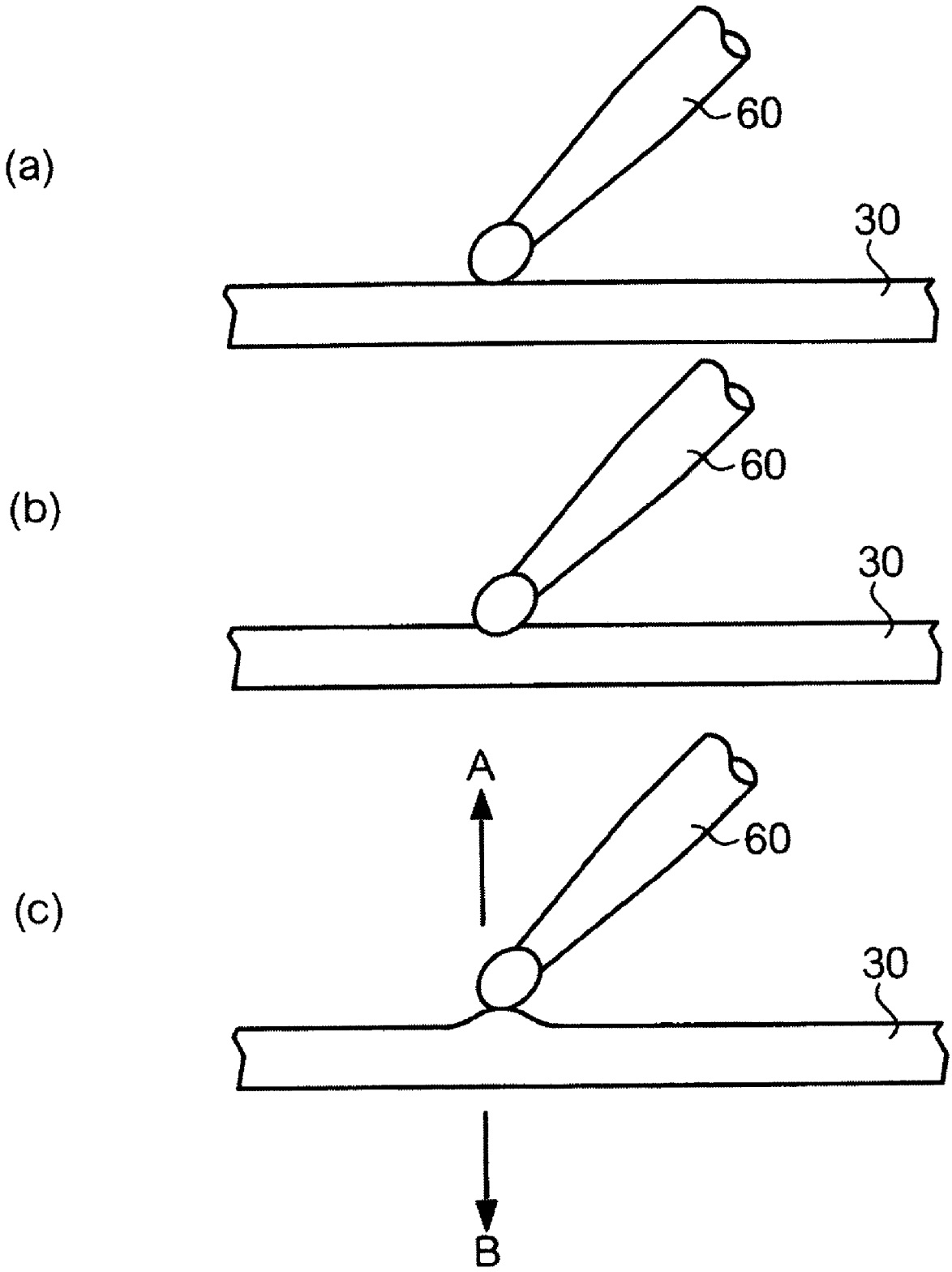
FIG. 2 depicts the changes in the surface of a pad to which zinc oxide starch powder is not applied.

The workings of the zinc oxide starch powder 40 will now be described. In a case where the zinc oxide starch powder 40 is not applied to the surface of the pad 30, when the pad 30 is hit with a stick 60 as shown in FIG. 2(*a*), the adhesion of the pad 30 causes the stick 60 to adhere to the pad 30. When the surface of the pad 30 is then dented due to the hit with the stick 60 as shown in FIG. 2(*b*), the force restoring the dent is exerted on the pad 30. Due to this restoring force, the stick 60 is bounced back in the direction (arrow A in FIG. 2(*c*)) opposite to the hit, however, the stick 60 adhering to the pad 30 due to the adhesion of the pad 30 draws up the surface of the pad 30 as shown in FIG. 2(*c*). When the surface of the pad 30 is drawn up by the stick 60, the force restoring the drawn surface is produced on the pad 30. When the surface of the pad 30 is restored, the adhesion of the stick 60 to the pad 30 causes the force acting on the stick 60 in the direction opposite to that in which the stick 60 is bounced back (arrow B in FIG. 2(*c*)), resulting in reduced repulsion. Consequently, the pad 30 without the zinc oxide starch powder 40 fails to provide players with the feeling of repulsion that acoustic drums can bring.

Figure 3:
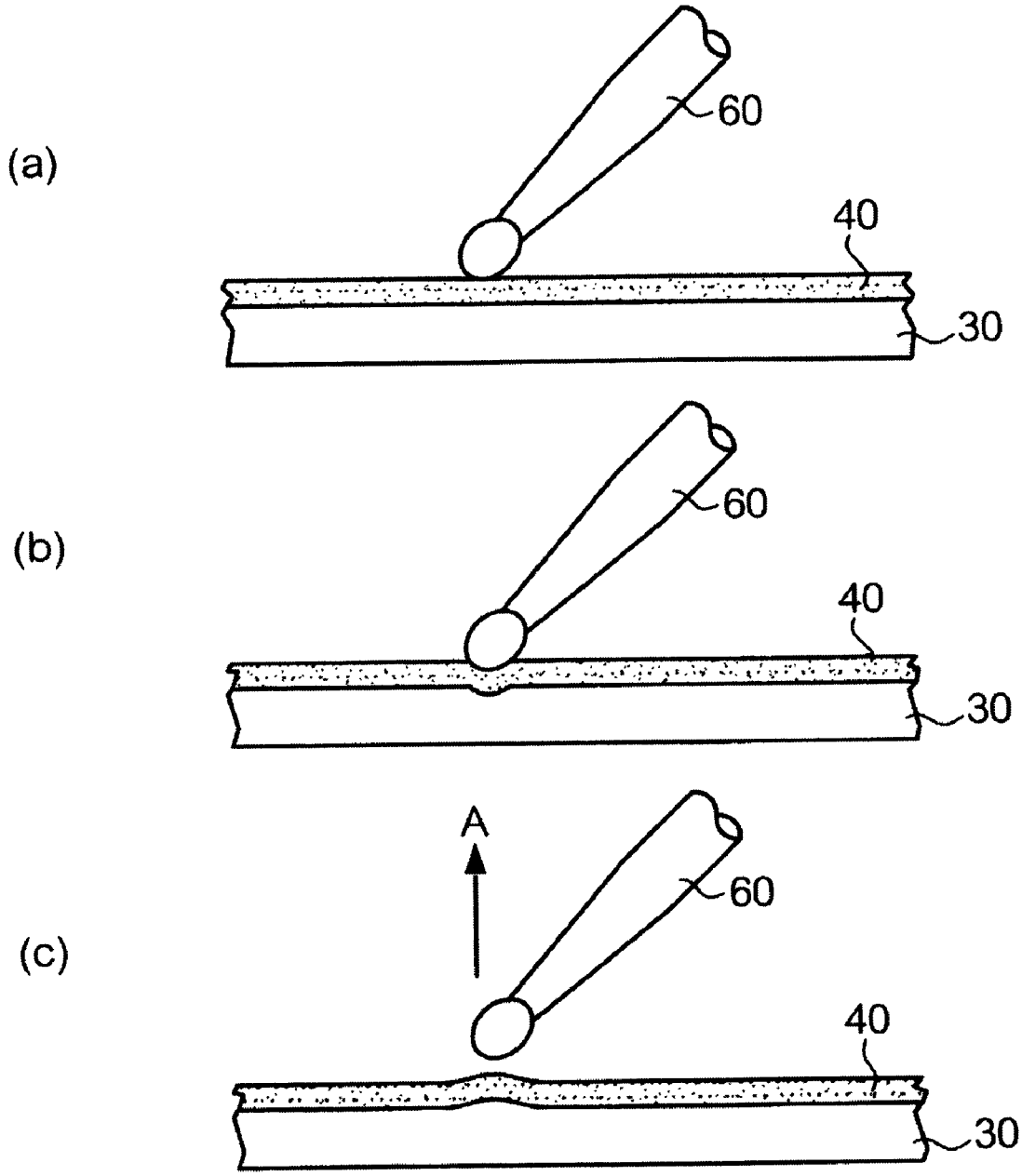
FIG. 3 depicts the changes in the surface of the pad to which zinc oxide starch powder is applied.

In a case where the zinc oxide starch powder 40 is applied to the surface of the pad 30, on the other hand, the zinc oxide starch powder 40 imparts slipping properties to the surface of the pad 30 to prevent the stick 60 from directly touching the pad 30 and adhering to the pad 30 when the pad 30 is hit with the stick 60 shown in FIG. 2(*a*). When the surface of the pad 30 is then dented by the hit with the stick 60 as shown in FIG. 3(*b*), the force restoring the surface by use of elasticity is produced on the pad 30. Since the stick 60 is not adhered to the pad 30 in this case, repulsion of the stick 60 from the pad 30 does not involve drawing up surface of the pad 30. More specifically, when the stick 60 is bounced back by the pad 30, the force acting in the direction opposite to that in which the stick 60 bounces is not exerted on the stick 60. As a result, repulsion of the stick 60 from the pad 30 is maintained to provide players with the feeling of repulsion just like an acoustic drum.

Differences in repulsion were quantified and shown in FIG. 4. The present inventor dropped a steel ball measuring ⅝ of an inch in diameter from heights of 100 mm and 300 mm onto the pad 30 made of olefinic elastomer in order to obtain the percentage of repulsion (the ratio of the height where the steel ball is dropped to the height where the steel ball is brought to the highest point by repulsion). In FIG. 4 there is shown the result of this experiment, i.e., the percentage of repulsion in a case where the zinc oxide starch powder 40 is applied to the surface of the pad 30 and a case where the zinc oxide starch powder 40 is not applied. When the pad 30 is not subjected to any processing or treatment, the percentage of repulsion in a case where the steel ball was dropped from a height of 100 mm was, as shown in FIG. 4, 63.6 percent, while the percentage of repulsion in a case where the steel ball was dropped from a height of 300 mm was 60.6 percent. When the zinc oxide starch powder 40 was applied to the pad 30, on the other hand, the percentage of repulsion in a case where the steel ball was dropped from a height of 100 mm was 72.3 percent, while the percentage of repulsion in a case where the steel ball was dropped from a height of 300 mm was 66.0 percent. Compared to the cases where the zinc oxide starch powder 40 is not applied, the pad 30 to which the zinc oxide starch powder 40 is applied had higher repulsion.

As described above, the present embodiment provides the stick 60 with appropriate repulsion without adhesion of the stick 60 to the pad 30 even if the pad 30 which is hit with the stick 60 is adhesive, allowing players to obtain natural feeling of repulsion just like an acoustic drum. Since the pad 30 can be made of flexible elastomer, furthermore, the pad 30 is soft in feel when players hit the pad 30 with sticks, enabling them to play the drum for long hours. In addition, the pad 30 made of flexible elastomer reduces the noise produced when the stick 60 collides with the pad 30. As apparent from the result shown in FIG. 4, moreover, since weaker hits exhibit higher percentage in repulsion, the present embodiment facilitates player's control of the stick 60 when they play fast with short intervals between the hits.

MODIFIED EXAMPLES

An embodiment of the present invention has been described above, however, the above-described embodiment may be modified as described below.

Powder applied to the surface of the pad 30 is not limited to zinc oxide starch powder, but may be any powder such as cornstarch, talc, silica and zinc oxide as long as it can reduce the adhesive properties of the pad 30. The degree of repulsion of the pad 30 can be changed by applying different types of powder having different physical properties. In accordance with the player's preference or the impression of a musical piece, therefore, the player can change the degree of repulsion by removing the powder that has already been applied and applying a different type of powder having different properties.

The pad 30 may be made of, for example, silicon elastomer or elastomer composed of gel material as far as such elastomer has adhesive properties. In addition, the pad 30 may have a plurality of minute depressions on its entire surface in order to reduce the area where the stick 60 contacts when the pad 30 is hit with the stick 60.

What is claimed is:

1. A head for a percussion instrument, the head comprising:
- a base member layer, the base layer being configured for fastening to a case of the percussion instrument;
- an elastic member layer laminated on a top surface of the base member layer and having elastic and adhesive properties; and
- a powder applied to a top surface of the elastic member layer, wherein the powder is adhered to the top surface of the elastic member layer by the adhesive properties of the elastic member layer, and wherein the powder reduces adhesion of a stick that strikes the elastic member layer.

2. A head for a percussion instrument according to claim 1, wherein the elastic member layer is a pad hit with a stick.

3. A head for a percussion instrument according to claim 1, wherein the powder includes at least one of zinc oxide, zinc oxide starch powder, cornstarch, talc and silica.

4. A head for a percussion instrument according to claim 1, wherein the elastic member layer is composed of an urethane or olefin material having adhesive and elastic properties.

5. A head for a percussion instrument according to claim 1, wherein the elastic member layer is composed of silicon elastomeric or elastomeric made of gel material.

6. A head for a percussion instrument according to claim 1, wherein the base member layer is a steel plate.

7. A head for a percussion instrument according to claim 1, the head further comprising:
- a vibration sensor provided on the undersurface of the base member layer and sensing vibration produced in the base member layer.

8. A head for a percussion instrument according to claim 7, wherein the vibration sensor is composed of a piezoelectric element.

9. A head for a percussion instrument according to claim 7, wherein the vibration sensor is connected to a musical tone generating portion for generating a musical tone signal on the basis of a signal indicative or a vibration output from the vibration sensor.

10. A head for a percussion instrument according to claim 1, wherein the base member layer is fastened to a case.

11. A head for a percussion instrument according to claim 10, wherein the case is composed of acrylonitrilebutadiene-styrene resin.

12. A head for a percussion instrument according to claim 1, wherein the head provides a repulsion of at least 66%.

* * * * *